US006224023B1

(12) United States Patent
Young et al.

(10) Patent No.: US 6,224,023 B1
(45) **Date of Patent: *May 1, 2001**

(54) RAILROAD SPRING FROG ASSEMBLY

(75) Inventors: Keith Young, Naperville; Stephen R. Kuhn, Richton Park, both of IL (US)

(73) Assignee: ABC Rail Products Corporation, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/235,892

(22) Filed: Jan. 22, 1999

(51) Int. Cl.[7] ..... E01B 7/10
(52) U.S. Cl. ..... 246/454; 246/417
(58) Field of Search ..... 246/415 R, 417, 246/454, 457, 468, 276

(56) References Cited

U.S. PATENT DOCUMENTS 514,630 * 2/1894 Stewart et al. ..... 246/276
654,039 * 7/1900 Wharton ..... 246/276
930,709 * 8/1909 Whiteman ..... 246/276
1,784,211 * 12/1930 Vissat ..... 246/417
4,624,428 * 11/1986 Frank ..... 246/468
5,292,091 * 3/1994 Callegari et al. ..... 246/448
5,782,437 * 7/1998 Irie et al. ..... 246/468
5,810,298 * 9/1998 Young et al. ..... 246/276

* cited by examiner

*Primary Examiner*—S. Joseph Morano
*Assistant Examiner*—Robert J. McCarry, Jr.
(74) *Attorney, Agent, or Firm*—Thomas S. Baker, Jr.

(57) ABSTRACT

An improved railroad trackwork spring wing frog is provided with a rail-closer having a single compression spring whose reaction forces are applied to the frog spring wing rail through movable linkages that are each connected to the spring wing rail at different spaced-apart position and that each abut the single compression spring.

3 Claims, 2 Drawing Sheets

FIG. 2
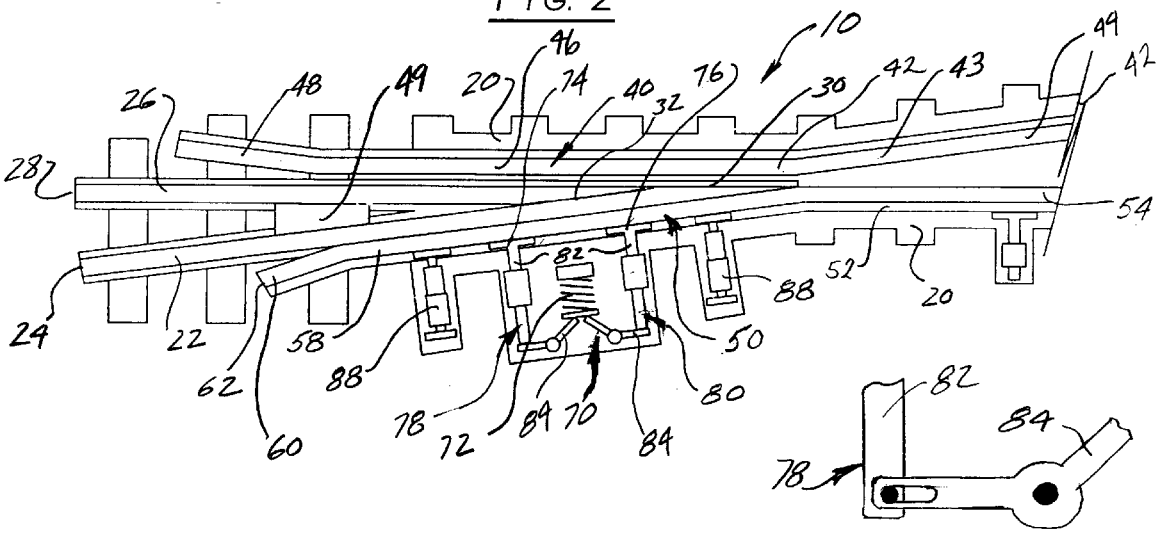
FIG. 4
FIG. 3
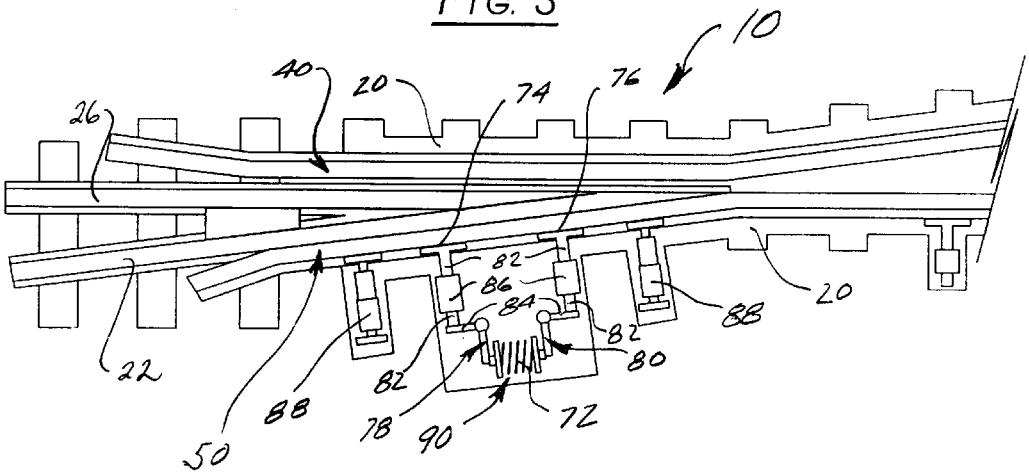

RAILROAD SPRING FROG ASSEMBLY

CROSS-REFERENCES

None.

FIELD OF THE INVENTION

This invention relates generally to railroad trackworks, and particularly concerns an improved trackwork frog assembly of the spring-rail type which is principally used at railroad trackwork turn-outs from main line track.

BACKGROUND OF THE INVENTION

U.S. Pat. No. 5,810,298, issued in the names of Young et al. and assigned to the assignee of this application, discloses a railroad rail frog assembly which advantageously utilizes multiple, spaced-apart rail closer elements to minimize otherwise occurring spring wing rail distortion.

It has now been additionally discovered in connection with the utilization of such prior art trackwork spring rail-type frog assemblies that a single, rather than multiple, spring-type, rail-closer element may be utilized advantageously and with equal effectiveness if that single, spring-type rail-closer is provided with multiple, spaced-apart points of application of closing forces to the connected spring wing rail.

Other objects and advantages of the present discovery will become apparent during a careful consideration of the invention summary, description of the drawings, and detailed description which follow.

SUMMARY OF THE INVENTION

The novel railroad trackwork frog assembly of this invention is essentially comprised of a base plate element, a frog long point or V-point element fixedly secured to the base plate element, a fixed wing rail element also fixedly secured to the base plate element, a laterally movable spring wing rail element mounted on the base plate element and having a free end portion, and a single rail-closer spring element with a connected linkage having two points of force application relative to the spring wing rail element. In addition, the invention frog assembly may advantageously incorporate at least one conventional slide-horn holddown subassembly into the connected linkage, such holddown subassembly (or subassemblies) functioning to control or maintain proper spring wing rail cross-section vertical orientation at all times during spring wing rail lateral movement. Also, the invention frog assembly may optionally and advantageously include one or more conventional shock absorber subassemblies combined with the spring wing rail element.

DESCRIPTION OF THE DRAWINGS

FIG. 2 is an enlarged plan view of the spring wing rail frog assembly portion of the FIG. 1 railroad trackwork intersection;

FIG. 3 is an enlarged plan view similar to FIG. 2 but illustrating an alternate multi-point linkage arrangement for effecting utilization of a single rail-closer spring element, and FIG. 4 is a schematic fragmentary detail of a slot-pivot connection between linkage elements of the invention FIGS. 2 and 3 multi-point linkages.

DETAILED DESCRIPTION

Figure 1:
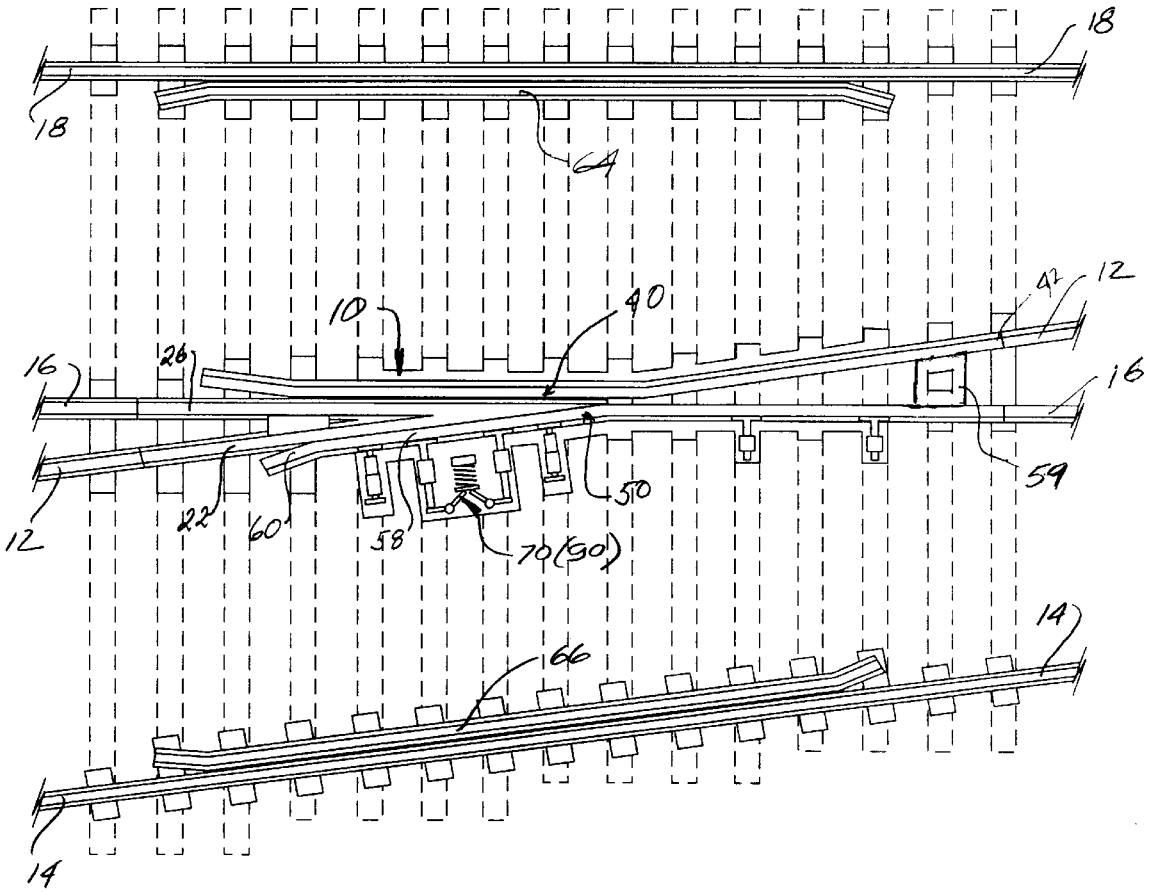
FIG. 1 is a plan view of a railroad trackwork intersection having a preferred embodiment of the spring wing rail frog assembly of the present invention incorporated therein.

Referring to FIG. 1, the frog assembly 10 of the present invention is shown inserted in one rail 12 of a pair of turnout rails 12, 14 and one rail 16 of a pair of mainline rails 16, 18. Spring frog 10 is assembled and mounted on a base plate element 20 which provides a level foundation for the frog and which maintains the elements which comprise the frog in their proper relationship during assembly, shipping, and subsequent installation in a railroad trackwork. Frog assembly 10 is functionally positioned to permit flanged rail car wheels riding along rail 12 to cross rail 16 and flanged rail car wheels riding along rail 16 to cross rail 12. A conventional switch stand for directing rail cars from rail pair 12, 14 to rail pair 16, 18 and vice versa is necessary for the trackwork but does not comprise a portion of frog assembly 10.

A long point rail element 22 (see FIG. 2) is mounted on base plate 20 at the heel end of frog assembly 10 and has a rail end 24 which upon frog installation is joined, as by welding, to turnout line rail 12 to provide a connection for that rail to frog assembly 10. A short point rail 26 is also mounted on base plate 20 and has a rail end 28 which upon frog installation is joined, as by welding, to mainline rail 16 to connect that rail to frog assembly 10. Long point rail element 22 and short point rail element 26 are mounted on base plate element 20 at an included angle relative to each other which is known as the angle of frog. A heel block element (not illustrated) may be bolted into position with and between point rail elements 22 and 26 to maintain the desired angle and spacing between such point rail elements, and also a heel riser element (not illustrated) may be provided to protect the point rails from damage due to car wheels having false flanges. See U.S. Pat. No. 4,362,282 for a description of the false flange protection problem.

Long point rail element 22 terminates with a tapered vertical surface 30 on one side which is substantially parallel with mainline rail 16, and short point rail element 26 terminates with a tapered vertical surface 32 on one side which is substantially parallel with turnout rail 12. Surface 32 is complementary to and engages one side of long point rail 22. The pointed end of long rail element 22 terminates with a width of approximately one-half inch and is known as the half inch point of the frog assembly.

The generally-curved, fixed wing rail element 40 of frog assembly 10 is connected to a curved closure rail section 43, has a long body section 44, and has a joined, angled body section 46 that is oriented generally parallel to short point rail element 26. Upon installation, closure rail section 43 is joined at its end 42 to a section of turnout rail 12. Also, the end 48 of wing rail element 40 is preferably flared so that the flange of a car wheel moving along short point rail element 26 toward element 40 will not strike the wing rail free end. A spacer block element 49 (see FIG. 1) may be advantageously mounted on base plate 20 at the toe end of frog assembly 10 and bolted to and between long body section 44 and the adjacent spring-rail body section to maintain proper spacing between those elements. Also, rigid wing rail element 40 is rigidly secured to base plate element 20 by conventional means such as plate clips. Thus, rigid wing rail element is a relatively immovable member of frog assembly 10.

The yieldably-mounted spring wing rail element 50, which is the primary movable member of frog assembly 10, has a straight, long body section 52 leading to an end 54 section that upon installation is joined to a mainline rail 16. Element 50 also has an angled body section 58 which is at the opposite end of long body section 52. Angled body section 58 is parallel to and engages (abuts) the side of long point rail 22 opposite that engaged by short point rail 26. The free end 60 of angled body section 58 is flared so that no portion of its very end 62 can be accidentally struck by the flange of a car wheel moving from the long point rail element 22 toward spring wing rail element 50. An additional conventional spacer block 59 may, as in the case of spacer block 49, be advantageously positioned in assembly 10, but between and connected to spring wing rail element 50 and to rigid wing rail element 40, to maintain their desired spacing and included angle of intersection. It should be noted that spring wing rail 50 at its angled body section 58 and at its free end 60 is not secured to base plate element 20 either by conventional plate clips or the like.

Thus, when the flange of a car wheel engages spring wing rail 50 at its free end 60 and causes it to move laterally so that a flangeway is provided between long point rail 22 and spring wing rail 50, rail 50 is stressed and flexed from the point of wheel engagement to where it is attached to spacer block 59. Spring wing rail element 50 is acting essentially as a cantilevered beam with a force applied at or close to its free end 60.

The railroad trackwork installation shown in FIG. 1 also typically includes a pair of conventional guard rail elements 64, 66 (see FIG. 1) having flared ends which are positioned at turnout rail 14 and at mainline rail 18, each in spaced-apart relation to the adjacent rail by a distance that is slightly greater than the standard car wheel flange thickness, respectively. Such function to "protect" rail 50 from lateral forces caused by possibly-skewed car wheels.

Spring wing frog assembly 10 includes a single rail-closer subassembly 70 (90 in FIG. 3) which develops a substantial initial compression force that maintains spring wing rail 50 in its abutting engagement with long point rail element 22 in the absence of rail car traffic passing through assembly 10. Assembly 10 also typically includes conventional rail hold-down subassemblies 88 which function to prevent the angled body portion of spring wing rail 58 from being transversely twisted by rail-opening forces applied to the upper or head portion of the angled body portion of such spring wing rail by a railcar wheel passing through the frog assembly. Subassembly 70 is characterized as having a single compression spring element 72 that develops an increased compression force resisting opening movement of spring wing rail element 50 as that rail is moved laterally by a rail car wheel flanges passing through the frog assembly, and that utilizes such increased compression force to forcefully close spring wing rail element 50 and move it into its initial position of forceful contact with long point rail element 22 after a co-operating rail car wheel flange has passed through the frog assembly. Such subassembly 70 differs from the prior art A.R.E.A. single point compression closure spring subassembly, however, in that the single spring element 72 has two points of force application 74, 76 that are spaced-apart along spring wing rail element 50 and that are each connected to the same single compression spring element 72 by one of two connecting linkages 78 and 80.

Nominally, each connecting linkage 78, 80 is basically comprised of rigid link 82, which may take the form of a holddown subassembly slide horn that is fixedly connected to the spring wing rail 50, and a pivoted bell-crank 84 that is pivotally connected to link 82 by a slot-pivot combination as shown in FIG. 4 and that abuts one end (FIG. 2) or both ends (FIG. 3) of fixedly positioned compression spring 72. If functioning as part of a holddown subassembly, each rigid link 82 slidably co-operates with a holddown cover 86 that is fixedly secured to base plate element 22 by an appropriate weldment or other fastener.

The principal differences between rail-closer subassemblies 70 and 90 normally are different rigid link lengths, different orientation of fixedly positioned single spring element 72, and relative angular separation of the arms of the differently illustrated bell-crank elements 84.

Other component shapes, sizes, and materials than those mentioned, illustrated, or described may be substituted and yet obtain the advantages of this invention and without departing from the claimed scope of the invention.

We claim as our invention the apparatus defined by the following claims:

1. In a railroad trackwork frog assembly having a fixed frog point, a relatively fixed rigid wing rail, and a partially movable spring wing rail, in combination:

a base plate element;

a spring wing rail element having a long body portion which is fixedly attached to said base plate element, and an angled body portion which is an integral continuation of said long body portion and which is supported by and transversely movable relative to said base plate element; and a rail-closer element fixedly secured to said base plate element, yieldably secured to said spring wing rail element, and having a single compression spring element, and a pair of movable linkages that are each connected to said spring wing rail element at a different spaced-apart position along the length of said spring wing rail element angled body portion and that each abut an end of said single compression spring element.

2. The invention defined by claim 1 wherein said rail-closer element movable linkages each include a holddown subassembly slide horn element fixedly attached to said spring wing rail element angled body portion.

3. The invention defined by claim 1 wherein said rail-closer element movable linkages each include a rigid link element connected to said spring wing rail element and a pivoted bell-crank element, said bell-crank element being pivotally connected to said rigid link element and abutting said single compression spring element.

* * * * *